United States Patent [19]

Sinclair

[11] Patent Number: 4,642,020

[45] Date of Patent: Feb. 10, 1987

[54] TUBULAR SLIDE LIFT TRUCK ATTACHMENT

[75] Inventor: Stuart W. Sinclair, Lake Jackson, Tex.

[73] Assignee: Long Reach Manufacturing Co., Houston, Tex.

[21] Appl. No.: 696,975

[22] Filed: Jan. 31, 1985

[51] Int. Cl.[4] ..... B66F 9/18

[52] U.S. Cl. ..... 414/621; 294/119.1; 384/26

[58] Field of Search ..... 414/621, 671; 294/81.21, 88, 119.1; 296/188, 205, 209; 293/122; 308/3 R; 280/763.1–766.1

[56] References Cited

U.S. PATENT DOCUMENTS

| | | | |
|---|---|---|---|
| 1,753,411 | 4/1930 | Gunn | 293/122 |
| 2,671,571 | 3/1954 | Gerhardt | 414/621 |
| 3,245,562 | 4/1966 | Horton | 414/621 |
| 3,370,880 | 2/1968 | Carliss et al. | 414/621 X |
| 3,450,288 | 6/1969 | Walsh | 414/621 X |
| 4,090,628 | 5/1978 | Sinclair | 414/621 X |
| 4,185,944 | 1/1980 | Seaberg | 414/621 |
| 4,279,564 | 7/1981 | Weinert | 414/621 |

*Primary Examiner*—Joseph E. Valenza
*Assistant Examiner*—David A. Bucci
*Attorney, Agent, or Firm*—Fulbright & Jaworski

[57] ABSTRACT

A clamp attachment for use on a lift truck having a body adapted to be mounted on a lift truck which includes a plurality of elongate spaced parallel guides. Each guide supports a longitudinally movable slide connected to a load clamp and actuated by piston and cylinder assembly. The slides are reduced in weight by being tubular members and a solid heel support member is positioned in the outer end of each of the tubular members for providing strength. The heel support fills the cross-sectional area of the tubular slide. A heel plate which is connected to and supports a load clamp is bolted to the slide and heel support. The heel extends a distance into the end of the slide sufficient to reduce the stress concentration through a cross section containing a bolt to less than the stress concentration in the tubular slide alone. The solid heel support member is of a higher breaking strength than the tubular slide.

8 Claims, 7 Drawing Figures

TUBULAR SLIDE LIFT TRUCK ATTACHMENT

BACKGROUND OF THE INVENTION

It is well known to provide a clamp for a lift truck having clamp arms which are connected to slides moving within parallel guides and actuated by a hydraulic piston and cylinder assembly. The various problems of stress concentration and failures in the slides and their connections to the clamp arms is discussed in U.S. Pat. No. 4,185,944.

It is important to have a clamp arm and slide mechanism which has the necessary strength, at a low cost, with low weight, but one that can be inexpensively and easily repaired or replaced. However, the achievement of one of these objectives is generally at the expense of other of the objectives. For example, the strength can be increased by providing a solid slide with the clamp arms welded thereto. However, this solution increases the weight undesirably, increases the cost, and increases the cost and difficulty of repairs. On the other hand, using a tubular slide advantageously decreases the weight and cost, but disadvantageously reduces the strength, and bolted connections generally further weaken a member.

The present invention is directed to an improved slide and clamp arm connection which reduces weight, cost, allows easy replacement at low cost, while increasing the strength of a tubular member with holes.

SUMMARY OF THE INVENTION

The present invention is directed to a load carrying clamp attachment for use on a lift truck having a body adapted to be mounted on a lift truck. The body includes a plurality of elongate spaced parallel guides in which each guide supports a longitudinally movable slide. A load clamp arm connected to the end of each slide for movement towards and away from each other for supporting and releasing a load. Piston and cylinder means are provided for moving the clamps relative to each other. The improvement is directed to providing a slide which is a tubular member with a solid heel support member positioned in the outer ends of each of the tubular members in which the heel generally fills the cross-sectional area of the tubular slide for strength. A heel plate is connected to and supports a load clamp and is bolted to the slide and heel support. Each of the members is a low cost element which can be easily installed and repaired, but the combination provides an increased strength connection as compared to a conventional tubular slide which is weldably connected to a clamp arm.

Still a further object is wherein the heel supports extend into the tubular slides a distance sufficient to reduce the stress concentration through a cross-section containing a bolt to less than the stress concentration in the tubular slide alone.

Still a further object of the present invention is wherein the solid heel support member is of a higher breaking strength than the breaking strength of the tubular slide.

Yet a further object is the provision of a spacer positioned between the heel plate and the outside of the tubular slide.

Yet a still further object is the provision of a plurality of bolts connecting the heel plate to the slide and heel support in which the bolts are spaced longitudinally along the slide and extend perpendicularly to the longitudinal axis of the slide. Preferably the cross-section of the tubular slide and the heel support are rectangular.

A still further object of the present invention is wherein the plurality of bolts extend through the heel plate into the tubular slide and the heel support except for the bolt in the outer end which extends through the slide and heel support and into the heel plate.

Other and further objects, features and advantages will be apparent from the following description of a present preferred embodiment of the invention, given for the purpose of disclosure and taken into conjunction with the accompanying drawings.

DESCRIPTION OF THE PREFERRED EMBODIMENT

Figure 1:
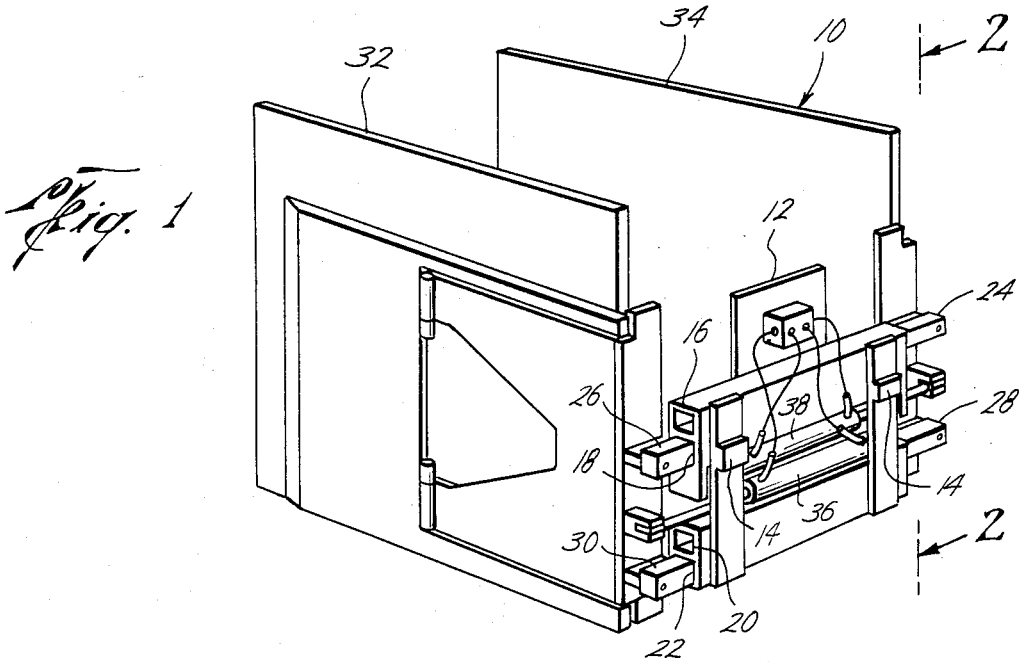
FIG. 1 is an elevational, perspective view of the clamp attachment of the present invention which is adapted to be connected to a lift truck.

Referring now to the drawings, particularly to FIG. 1, the reference numeral 10 generally indicates the load carrying clamp attachment of the present invention which is adapted to be mounted on a lift truck for picking up, carrying, and releasing various types of loads. The attachment 10 includes a body 12 having mounting hooks 14 to be carried from the supports of a lift truck (not shown). The body includes a plurality of elongate vertically spaced parallel guides such as guides 16, 18, 20, and 22. Each of the guides supports a longitudinally movable slide. Thus guides 16, 18, 20 and 22 support movable slides 24, 26, 28 and 30, respectively. First and second load clamps or arms 32 and 34 are provided for gripping, carrying, and releasing various types of loads, here shown as suitable clamps for handling cartons although other types of clamps may be used. The clamp 32 is connected to one or more slides such as slides 26 and 30 while clamp 34 is connected to slides 24 and 28. First and second piston and cylinder assemblies 36 and 38 are provided connected to the load clamps 32 and 34, respectively, for movement of the clamps 32 and 34 towards and away from each other.

Figure 2:
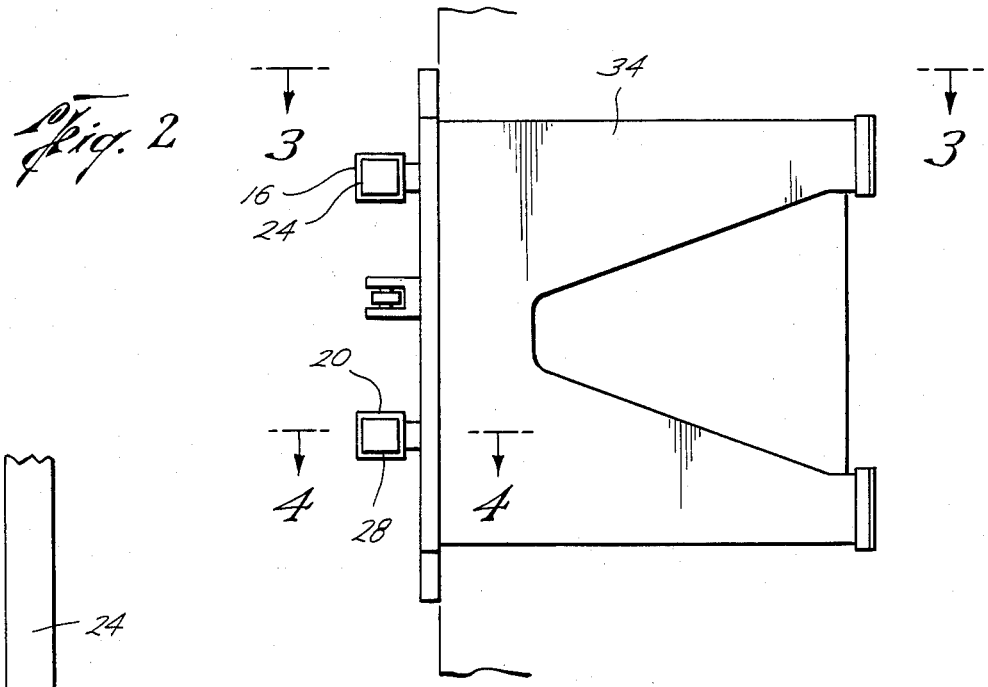
FIG. 2 is a cross-sectional view taken along the line 2—2 of FIG. 1.
Figure 3:
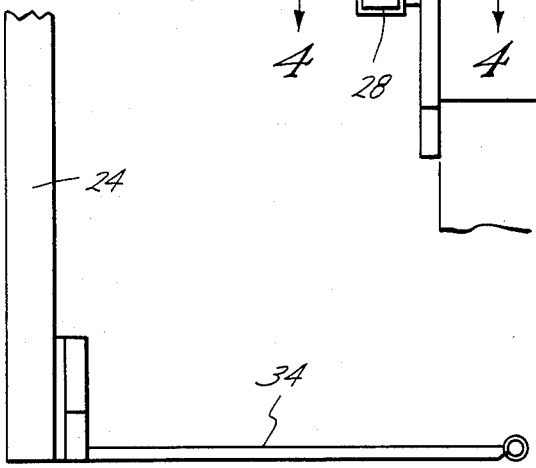
FIG. 3 is a cross-sectional view taken along the line 3—3 of FIG. 2.
Figure 4:
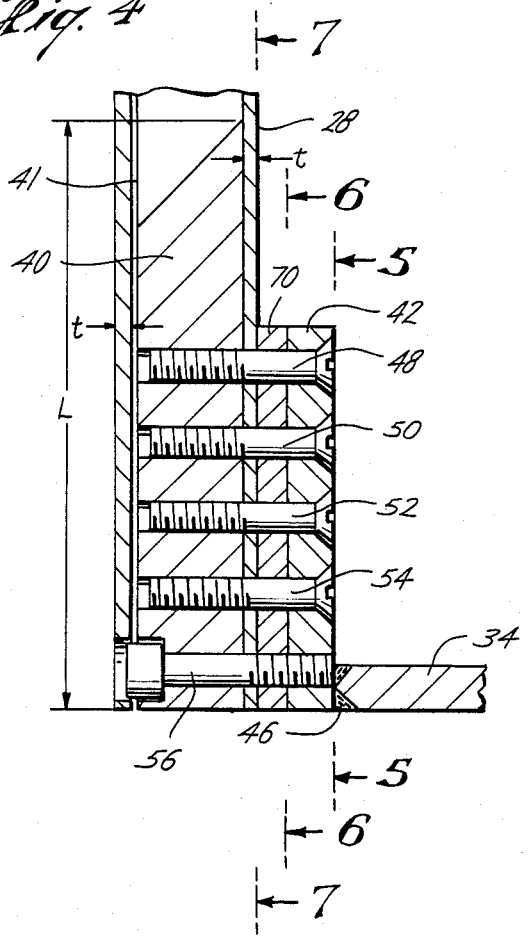
FIG. 4 is an enlarged fragmentary view taken along the line 4—4 of FIG. 2.
Figure 5:
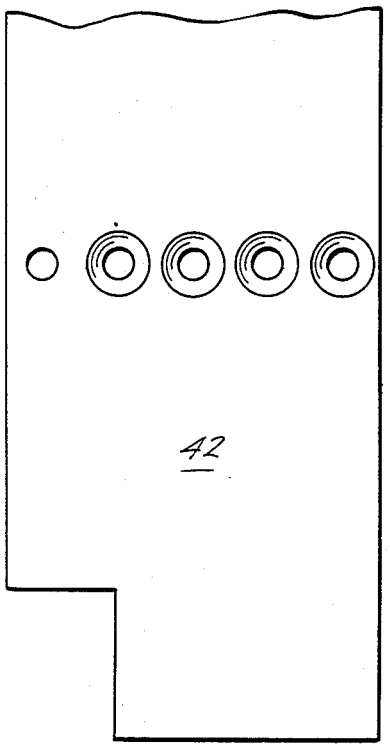
FIG. 5 is a view taken along the line 5—5 of FIG. 4.
Figure 6:
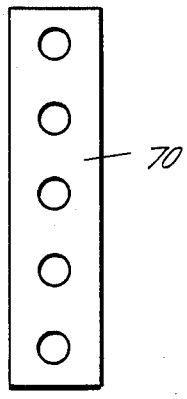
FIG. 6 is a cross-sectional view taken along the line 6—6 of FIG. 4.
Figure 7:
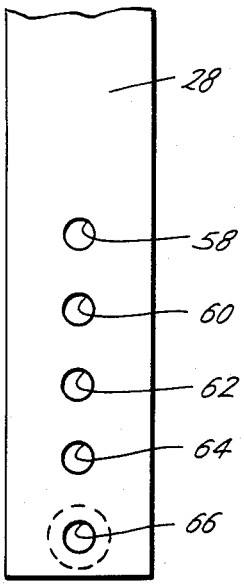
FIG. 7 is a cross-sectional view taken along the line 7—7 of FIG. 4.

The above general description of a load carrying clamp attachment for a lift truck is known. Referring now to FIGS. 2, 3 and 4, the guides 16, 18, 20 and 22 are hollow guides, preferably rectangular and the slides 24, 26, 28 and 30 are tubular members such as square structural tubing which provides a simple, inexpensive, and light-weight guide. Such guides have been used in the past in which the clamping arm has been welded to the ends of the guides. However, in use, the clamping structure has been subjected to high bending moments causing fatigue and failure and breakage. Repair and replacement of such failures are expensive.

The present invention is directed to providing a solid heel support member 40 positioned in the end of each of the tubular slides such as slide 28 shown in FIG. 4. The heel 40 generally fills the cross-sectional area of the tubular slide 28 (except for allowance for any welded bead 41 section) and thus has a cross-sectional area matching the interior cross-sectional area of the tubular member 28. A heel plate 42 is provided which is connected to one of the load clamp or arms such as 34 preferably by welding 46. The heel plate is bolted to the side of the slide 28 and support 40 by a plurality of bolts 48, 50, 52, 54, and 56. The bolts extend through holes 58, 60, 62, 64 and 66 in the tubular member 28. Normally, it would be undesirable to drill the holes 58, 60, 62, 64 and 66 through the slide 28 as that weakens the structural strength of the slide 28. However, the support of the solid heel support 40 overcomes the weakness in the slide 28 and in fact makes a stronger connection. The length of the heel support 40 is sufficient to reduce the bending moment caused in the slide 28 at the cross sections of the tubular slide 28 at the holes 58, 60, 62, 64 and 66. That is, while the section modulus is reduced at the bolt holes 58, 60, 62, 64 and 66, the bending moments at these locations will be reduced more than the reduction in the section modulus at these cross-sections so that the stress concentration at the bolts 48, 50, 52 and 54 is less than the unit stress in the tubular slide 28 alone.

The length of the heel support is as follows:

$$L \geqq 4\left(\frac{Z}{t}\right)^{\frac{1}{2}}$$

where L is the length of the heel support, Z is the section modulus of the slide 28, and t is the wall thickness of the slide 28.

Preferably, the breaking strength of the solid heel 40 is greater than the breaking strength of the tubular slide 28. For example only, assuming that the tubular slide 28 is a 3"×3"×5/16 wall square structural tubing which has an ultimate tensile strength of 58,000 psi and a yield tensile strength of 46,000 psi, the solid heel 40 of T-1 material has an ultimate tensile strength of 125,000 psi and a yield tensile strength of 90,000 psi.

Preferably, a spacer 70 is provided between the exterior of the tubular slide 28 and the heel plate 42 for moving in a slot in the tracks and spacing out the heel plate 42 and arm 34 from the body 12.

Referring to FIG. 4, it is to be noted that while the bolts 48, 50, 52 and 54 are inserted and extend through the heel plate 42, the spacer 70 and into the tubular slide 28 and heel 40, the bolt 56 is inserted into and extends through the slide 28, heel support 40, again through slide 28, spacer 70 and into the heel plate 42 so as not to interfere with a clamp arm 34.

The present invention has the advantage of weight reduction in using the hollow slides 24, 26, 28 and 30 which require minimum manufacturing costs in merely cutting them to the proper length and drilling the necessary holes. Similarly, the bar stock heel support 40 may be easily cut and drilled and all of the parts easily and simply assembled. Secondly, in the event of a failure in the field, the failed part can be easily removed and installed. And thirdly and more importantly, the strength of the slides has been increased to.overcome the maximum stresses generally encountered in operation. All of these advantages have been obtained with a simple mechanically bolted connection.

The present invention, therefore, is well adapted to carry out the objects and obtain the ends and advantages mentioned as well as other inherent therein. While a presently preferred embodiment of the invention has been given for the purpose of disclosure, numerous changes in the details of construction and arrangement of parts may be made without departing from the spirit of the invention and the scope of the appended claims.

What is claimed is:

1. In a load carrying clamp attachment for use on a lift truck having a body adapted to be mounted on a lift truck, said body have a plurality of elongate spaced parallel guides, each guide supporting a longitudinally movable slide, first and second load clamps connected to said slides for movement toward and away from each other for supporting and releasing a load, and piston and cylinder means connected to said load clamps for moving said clamps relative to each other, the improvement in the slides comprising, said slides being metal tubular members, a solid metal heel supporting member for distributing the forces from a heel plate to a tubular member coaxially positioned in one end of each of said tubular members, said heel supporting member generally filling the cross-sectional area of the tubular member, said supporting members having a length less than the length of the tubular members, and a heel plate means connected to and supporting each load clamp, said heel plate means shaped to conform to the shape of the tubular member and bolted through a tubular member to the heel supporting member whereby the tubular members, heel supporting members and heel plate means are readily detachable from each other.

2. The apparatus of claim 1 in which said heel supporting members extend into the tubular slide a distance sufficient from the end to reduce the stress concentration through a cross section containing a bolt to less than the stress concentration in the tubular slide alone.

3. The apparatus of claim 2 wherein the length of the heel supporting member is:

$$L \geqq 4\left(\frac{Z}{t}\right)^{\frac{1}{2}}$$

wherein L is the length of the heel supporting member, Z is the section modulus of the tubular slide and t is the wall thickness of the tubular slide.

4. The apparatus of claim 2 wherein said solid heel supporting member is of a higher breaking strength than the breaking strength of the tubular slide.

5. The apparatus of claim 4, wherein the heel plate means includes a heel plate and a spacer shaped to conform to the outside of the tubular slide.

6. The apparatus of claim 5 including a plurality of bolts connecting the heel plate means to the slide and heel supporting member, said bolts being spaced longitudinal along the slide and perpendicular to the longitudinal axis of the slide.

7. The apparatus of claim 6 wherein the cross sections of the tubular slide and heel supporting member are rectangular.

8. The apparatus of claim 7 wherein the plurality of bolts extend through the heel plate means into the tubular slide and heel supporting member except for the bolt in the outer end which extends through the slide and heel supporting member and into the heel plate means.

* * * * *